US005091104A

United States Patent [19]

Van Der Puy

[11] Patent Number: 5,091,104

[45] Date of Patent: Feb. 25, 1992

[54] AZEOTROPE-LIKE COMPOSITIONS OF TERTIARY BUTYL 2,2,2-TRIFLUOROETHYL ETHER AND PERFLUOROMETHYLCYCLOHEXANE

[75] Inventor: Michael Van Der Puy, Cheektowaga, N.Y.

[73] Assignee: Allied-Signal Inc., Morris Township, N.J.

[21] Appl. No.: 721,022

[22] Filed: Jun. 26, 1991

[51] Int. Cl.[5] ..... C11D 7/30; C11D 7/50; C23G 5/028; B08B 3/00

[52] U.S. Cl. ..... 252/171; 134/12; 134/31; 134/38; 134/39; 134/40; 252/162; 252/170; 252/174.16; 252/364; 252/DIG. 9

[58] Field of Search ..... 252/67, 162, 170, 171, 252/174.16, 364, DIG. 9; 134/12, 31, 38, 39, 40

[56] References Cited

U.S. PATENT DOCUMENTS 4,219,489 8/1980 Johnson et al. ..... 555/502
4,675,453 6/1987 Resnick ..... 568/615
4,793,931 12/1988 Stevens et al. ..... 134/1
4,803,842 2/1989 Coelito et al. ..... 252/67

OTHER PUBLICATIONS

W. B. Burford III. et al., *Industrial and Engineering Chemistry* 1947 vol. 39, No. 3, p. 328.
*Fluorine Chemistry* vol. 2, Ed. J. H. Simons, 1954, Academic Press, NY.
Chemical Abstract No. 96:210105w abstract of Koller et al. *Anal. Chem.* 1982 vol. 54, No. 3, pp. 529-33.
PCR Catalog p. 119.

*Primary Examiner*—Paul Lieberman
*Assistant Examiner*—Linda D. Skaling
*Attorney, Agent, or Firm*—Colleen D. Szuch; Jay F. Friedenson

[57] ABSTRACT

Azeotrope-like compositions of tertiary butyl 2,2,2-trifluoroethyl ether and perfluoromethylcyclohexane which are useful in a variety of industrial cleaning applications including defluxing of printed circuit boards.

13 Claims, No Drawings

AZEOTROPE-LIKE COMPOSITIONS OF TERTIARY BUTYL 2,2,2-TRIFLUOROETHYL ETHER AND PERFLUOROMETHYLCYCLOHEXANE

FIELD OF THE INVENTION

This invention relates to azeotrope-like compositions of tertiary butyl 2,2,2-trifluoroethyl ether and perfluoromethylcyclohexane which are useful in a variety of industrial cleaning applications including defluxing of printed circuit boards.

BACKGROUND OF THE INVENTION

Fluorocarbon based solvents have been used extensively for the degreasing and otherwise cleaning of solid surfaces, especially intricate parts and difficult to remove soils. In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent leaves the object free of residue. This is contrasted with liquid solvents which leave deposits on the object after rinsing.

A vapor degreaser is used for difficult to remove soils where elevated temperature is necessary to improve the cleaning action of the solvent, or for large volume assembly line operations where the cleaning of metal parts and assemblies must be done efficiently. The conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al., in U.S. Pat. No. 3,085,918 disclose a suitable vapor degreaser comprising a boiling sump, a clean sump, a water separator, and other ancillary equipment.

Cold cleaning is another application where a number of solvents are used. In most cold cleaning applications, the soiled part is either immersed in the fluid or wiped with cloths soaked in solvents and allowed to air dry.

The art has looked towards azeotropic compositions including the desired fluorocarbon components such as trichlorotrifluoroethane, which include components which contribute additionally desired characteristics, such as polar functionality, increased solvency power, and stabilizers. Azeotropic compositions are desired because they do not fractionate upon boiling. This behavior is desirable because in the previously described vapor degreasing equipment with which these solvents are employed, redistilled material is generated for final rinse cleaning. Thus, the vapor degreasing system acts as a still. Therefore, unless the solvent composition is essentially constant boiling, (i.e., is an azeotrope or azeotrope-like) fractionation will occur and undesirable solvent distribution may act to upset the cleaning and safety of processing. For example, preferential evaporation of the more volatile components of the solvent mixtures would result in mixtures with changed compositions which may have less desirable properties, like lower solvency towards soils, less inertness towards metal, plastic or elastomer components, and increased flammability and toxicity (this would be the case if the mixture was not an azeotrope or azeotrope-like).

The art is continually seeking new fluorocarbon based azeotrope mixtures or azeotrope-like mixtures which offer alternatives for new and special cleaning applications for vapor degreasing and other cleaning applications. Currently, fluorocarbon based azeotrope-like mixtures are of particular interest because they are considered to be stratospherically safe substitutes for presently used fully halogenated chlorofluorocarbons. The latter have been implicated in causing environmental problems associated with the depletion of the earth's protective ozone layer.

Accordingly, it is an object of the present invention to provide novel environmentally acceptable azeotropic compositions which are useful in a variety of industrial cleaning applications.

It is another object of the invention to provide azeotrope-like compositions which are liquid at room temperature and which will not fractionate under conditions of use.

Other objects and advantages of the invention will become apparent from the following description.

SUMMARY OF THE INVENTION

The invention relates to azeotrope-like compositions of tertiary butyl 2,2,2-trifluoroethyl ether and perfluoromethylcyclohexane which are useful in a variety of industrial cleaning applications including defluxing of printed circuit boards.

DETAILED DESCRIPTION OF THE INVENTION

In accordance with the invention, novel azeotrope-like compositions have been discovered comprising tertiary butyl 2,2,2-trifluoroethyl ether and perfluoromethylcyclohexane. Preferably the azeotrope-like compositions comprise from about 20 to about 35 weight percent tertiary butyl 2,2,2-trifluoroethyl ether and from about 65 to about 80 weight percent perfluoromethylcyclohexane and boil at about 70.5° C. at 754 mm Hg.

In a more preferred embodiment, the azeotrope-like compositions of the invention comprise from about 25 to about 35 weight percent tertiary butyl 2,2,2-trifluoroethyl ether and from about 65 to about 75 weight percent perfluoromethylcyclohexane.

In a most preferred embodiment, the azeotrope-like compositions of the invention comprise from about 26 to about 34 weight percent tertiary butyl 2,2,2-trifluoroethyl ether and from about 66 to about 74 weight percent perfluoromethylcyclohexane.

The tertiary butyl 2,2,2-trifluoroethyl ether component of the invention has good solvent properties, but is flammable. The perfluoromethylcyclohexane component has poorer solvent properties but is nonflammable. When these components are combined in effective amounts, a synergistic blend having azeotropic properties results which is nonflammable and has good solvent capabilities.

It is known in the art that ether may exhibit the undesirable characteristic of forming peroxides especially when exposed to sun light or other radiation or stored for long periods of time. Furthermore, certain of the peroxides produced from decomposition of the ether are explosive and may be detonated by a shock. The art has recognized that certain stabilizers or anti-oxidant additives can be used to inhibit the decomposition of ether into the peroxide. Examples of such materials are alkyl or aryl phosphites such as diphenyl phosphite, triphenyl phosphite, tri-iso-octyl phosphite, di-octyl phosphite, and tri-iso-decyl phosphite, phenols such as 2,6-diethyl phenol, 2,4,6-triethyl phenol, 2,6-dipropyl phenol, and 2,4,6-tripropyl phosphite, and unsaturated hydrocarbons like cis and trans 4-methyl-2-pentene, cis and trans 2-hexene, 2-ethyl-1,3-butadiene, 1,2-pentadiene, cis and trans 1-hexene, and di-isobutylene. It is contemplated that such stabilizers may be combined with the azeotrope-like compositions of this invention.

It should be understood that the present compositions may include additional components so as to form new azeotrope-like compositions. Any such compositions are considered to be within the scope of the present invention as long as the compositions are essentially constant boiling and contain all the essential components described herein.

The perfluoromethylcyclohexane component of the invention is commercially available. It may be purchased, for example, from PCR, Inc. of Gainsville, Fla. Alternately, it may be prepared via cobalt trifluoride fluorination of benzotrifluoride. See, W. B. Burford III, et al., *Ind. Eng. Chem.*, 1947, 39, 319. The tertiary butyl 2,2,2-trifluoroethyl ether component of the invention may be prepared in accordance with the synthesis set forth in Example 1 below. Other methods of preparing perfluoromethylcyclohexane and tertiary butyl 2,2,2-trifluoroethyl ether will readily occur to those skilled in the art.

The perfluoromethylcyclohexane and tertiary butyl 2,2,2-trifluoroethyl ether components of the invention should be used in sufficiently high purity so as to avoid the introduction of adverse influences upon the constant boiling properties of the system.

The precise or true azeotrope compositions have not been determined but have been ascertained to be within the indicated ranges. Regardless of where the true azeotrope lies, all compositions within the indicated ranges, as well as certain compositions outside the indicated ranges, are azeotrope-like, as defined more particularly below.

From fundamental principles, the thermodynamic state of a fluid is defined by four variables: pressure, temperature, liquid composition and vapor composition, or P-T-X-Y, respectively. An azeotrope is a unique characteristic of a system of two or more components where X and Y are equal at the stated P and T. In practice, this means that the components of a mixture cannot be separated during distillation, and therefore are useful in vapor phase solvent cleaning as described above.

For purposes of this discussion, the term "azeotrope-like composition" is intended to mean that the composition behaves like a true azeotrope in terms of its constant-boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only slightly. This is contrasted with non-azeotrope-like compositions in which the liquid composition changes substantially during boiling or evaporation.

Thus, one way to determine whether a candidate mixture is "azeotrope-like" within the meaning of this invention, is to distill a sample thereof under conditions (i.e. resolution—number of plates) which would be expected to separate the mixture into its components. If the mixture is non-azeotropic or non-azeotrope-like, the mixture will fractionate, (i.e. separate into its various components) with the lowest boiling component distilling off first, etc. If the mixture is azeotrope-like, some finite amount of a first distillation cut will be obtained which contains all of the mixture components and which is constant boiling or behaves as a single substance. This phenomenon cannot occur if the mixture is not azeotrope-like (i.e., it is not part of an azeotropic system). If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above discussion that another characteristic of azeotrope-like compositions is that there is a range of compositions containing the same components in varying proportions which are azeotrope-like. All such compositions are intended to be covered by the term azeotrope-like as used herein. As an example, it is well known that at different pressures, the composition of a given azeotrope will vary at least slightly as does the boiling point of the composition. Thus, an azeotrope of A and B represents a unique type of relationship but with a variable composition depending on temperature and/or pressure. Accordingly, another way of defining azeotrope-like within the meaning of this invention is to state that such mixtures boil within about $\pm 1.5°$ C. (at 754 mm Hg) of the 70.5° C. boiling point disclosed herein. As is readily understood by persons skilled in the art, the boiling point of the azeotrope will vary with the pressure.

In the process embodiment of the invention, the azeotrope-like compositions of the invention may be used to clean solid surfaces by treating said surfaces with said compositions in any manner well known to the art such as by dipping or spraying or use of conventional degreasing apparatus.

When the present azeotrope-like compositions are used to clean solid surfaces by spraying the surfaces with the compositions, preferably, the azeotrope-like compositions are sprayed onto the surfaces by using a propellant. Preferably, the propellant is selected from the group consisting of nonflammable chlorofluorocarbons, hydrochlorofluorocarbon, hydrofluorocarbon, carbon dioxide, nitrogen, nitrous oxide, air, and mixtures thereof.

Useful chlorofluorocarbon propellants include trichlorofluoromethane (known in the art as CFC-11), dichlorodifluoromethane (known in the art as CFC-12), 1,1,2-trichloro-1,2,2-trifluoroethane (known in the art as CFC-113), and 1,2-dichloro-1,1,2,2-tetrafluoroethane (known in the art as CFC-114); commercially available CFC-11, CFC-12, CFC-113, and CFC-114 may be used in the present invention.

Useful hydrochlorofluorocarbon propellants include dichlorofluoromethane (known in the art as HCFC-21), chlorodifluoromethane (known in the art as HCFC-22), 1-chloro-1,2,2,2-tetrafluoroethane (known in the art as HCFC-124), 1,1-dichloro-2,2-difluoroethane (known in the art as HCFC-132*a*), 1-chloro-2,2,2-trifluoroethane (known in the art as HCFC-133), and 1-chloro-1-difluoroethane (known in the art as HCFC-142*b*); commercially available HCFC-21, HCFC-22 and HCFC-142*b* may be used in the present invention. HCFC-124 may be prepared by a known process such as that taught by U.S. Pat. No. 4,843,181 and HCFC-133 may be prepared by a known process such as that taught by U.S. Pat. No. 3,003,003.

Useful hydrofluorocarbon propellants include trifluoromethane (known in the art as HFC-23), 1,1,1,2-tetrafluoroethane (known in the art as HFC-134*a*), and 1,1-difluoroethane (known in the art as HFC-152*a*); commercially available HFC-23 and HFC-152a may be used in the present invention. Until HFC-134*a* becomes available in commercial quantities, HFC-134*a* may be prepared by any known method such as that disclosed by U.S. Pat. No. 4,851,595. More preferred propellants include hydrochlorofluorocarbons and hydrofluorocarbons. The most preferred propellants include chlorodifluoromethane and 1,1,1,2-tetrafluoroethane.

Having described the invention in detail and with reference to preferred embodiments thereof, it will be apparent that modifications and variations are possible without departing from the scope of the invention defined in the appended claims.

The present invention is more fully illustrated by the following non-limiting Examples.

EXAMPLE 1

Preparation of tertiary butyl 2,2,2-trifluoroethyl ether

Approximately 55 g (0.55 mol) trifluoroethanol and 2 g concentrated sulfuric acid were placed in a 300 ml glass pressure bottle equipped with a magnetic stir bar and pressure gauge. The pressure bottle was evacuated briefly and the stirred contents were cooled in a water bath at about 20° C. in order to moderate the temperature of the somewhat exothermic reaction with isobutylene. Isobutylene was then added to a pressure of about 20 psig. The isobutylene supply was turned off and the reaction was monitored by the decrease in pressure in the glass reactor. After the pressure had fallen to 0 psig, additional isobutylene was charged. In this manner, a total of 20.1 g (0.359 mol) isobutylene was added. The mixture was then poured into 300 ml of cold water and extracted with 50 ml of dodecane. The organic layer was separated, washed with three (3) 50 ml portions of water and dried over anhydrous powdered magnesium sulfate. The organic layer was distilled affording 28.5 g (51%) tertiary butyl 2,2,2-trifluoroethyl ether, bp 82.5°–84° C. 1H NMR (CDCl3): δ 3.77 (q, 2H, J=8 Hz), 1.25 (s, 9 H).

EXAMPLE 2

The compositional range over which tertiary butyl 2,2,2-trifluoroethylether andperfluoromethylcyclohexane exhibit constant boiling behavior was determined using ebulliometry. The ebulliometer consisted of a heated sump in which the tertiary butyl 2,2,2-trifluoroethyl ether was brought to a boil. The upper part of the ebulliometer connected to the sump was cooled, thereby acting as a condenser for the boiling vapors, allowing the system to operate at total reflux. After bringing the tertiary butyl 2,2,2-trifluoroethyl ether to a boil at atmospheric pressure, measured amounts of perfluoromethylcyclohexane were titrated into the ebulliometer. The change in boiling point was measured using a mercury thermometer graduated from 50° to 80° C. in 0.1° C. increments.

The results indicated that compositions of tertiary butyl 2,2,2-trifluoroethyl ether and perfluoromethylcyclohexane ranging from about 20 to about 40 weight percent tertiary butyl 2,2,2-trifluoroethyl ether and from about 60 to about 80 weight percent perfluoromethylcyclohexane exhibit constant boiling behavior at 70.5° C.±1.5° C. at 754 mm Hg.

EXAMPLE 3

The ability of a liquid composition to clean in cold cleaning, precision cleaning and related applications is highly dependent upon the ability of the material to substantially dissolve greases, oils, fluxes, and other contaminants (as opposed to physically removing soils as by wiping or spraying). We have therefore determined the solubility of model soils in the novel azeotropic solvent as an indication of its utility in cleaning applications as follows:

A 33/67 weight percent mixture of tertiary butyl 2,2,2-trifluoroethyl ether and perfluoromethylcyclohexane respectively was prepared. To this mixture was added 7 volume percent mineral oil. The solvent/mineral oil mixture was refluxed. The tertiary butyl 2,2,2-trifluoroethyl ether and perfluoromethylcyclohexane mixture readily dissolved the mineral oil at reflux as determined by visual inspection. The solubility test outlined above was repeated using hexadecane. The tertiary butyl-2,2,2-trifluoroethyl ether and perfluoromethylcyclohexane mixture readily dissolved the hexadecane at reflux as determined by a visual inspection.

EXAMPLE 4

The flash point of a 33/67 weight percent mixture of tertiary butyl 2,2,2-trifluoroethyl ether and perfluoromethylcyclohexane respectively was determined using the SETA flash closed-cup flashpoint tester. The tertiary butyl 2,2,2-trifluoroethyl ether and perfluoromethylcyclohexane mixture failed to exhibit a closed cup flashpoint up to an operating temperature of 160° F.

Having described the invention in detail and by reference to preferred embodiments thereof, it will be apparent that modifications and variations are possible without departing from the scope of the invention defined in the appended claims.

What is claimed:

1. Azeotrope-like compositions consisting essentially of from about 20 to about 35 weight percent tertiary butyl 2,2,2-trifluoroethyl ether and from about to about 80 weight percent perfluoromethylcyclohexane which boil at about 70.5° C. at 754 m Hg.

2. The azeotrope-like composition of claim 1 wherein said composition boils at about 70.5° C.±1.5° C. at 754 mm Hg.

3. The azeotrope-like compositions of claim 1 wherein said compositions consist essentially of from about 25 to about 35 weight percent tertiary butyl 2,2,2-trifluoroethyl ether and from about 65 to about 75 weight percent perfluoromethylcyclohexane.

4. The azeotrope-like compositions of claim 1 wherein said compositions consist essentially of from about 26 to about 34 weight percent tertiary butyl 2,2,2-trifluoroethyl ether and from about 66 to about 74 weight percent perfluoromethylcyclohexane.

5. The azeotrope-like compositions of claim 1 wherein said compositions additionally contain an inhibitor in an effective amount to inhibit the decomposition of the ether.

6. The azeotrope-like compositions of claim 3 wherein said compositions additionally contain an inhibitor in an effective amount to inhibit the decomposition of the ether.

7. The azeotrope-like compositions of claim 4 wherein said compositions additionally contain an inhibitor in an effective amount to inhibit the decomposition of the ether.

8. The azeotrope-like compositions of claim 5 wherein said inhibitor is selected from the group consisting of diphenyl phosphite, triphenyl phosphite, tri-iso-octyl phosphite, di-octyl phosphite, tri-iso-decyl, phosphite, 2,6-diethyl phenol, 2,4,6-triethyl phenol, 2,6-dipropyl phenol, 2,4,6-tripropyl phosphite, cis-2-hexane, trans-2-hexane,2-ethyl-1,3-butadiene, 1,2-pentadiene, cis-1-hexene, trans-1-hexene, and di-isobuytylene.

9. The azeotrope-like compositions of claim 6 wherein said inhibitor is selected from the group consisting of diphenyl phosphite, triphenyl phosphite, tri-iso-octyl phosphite, di-octyl phosphite, tri-iso-decyl phosphite, 2,6-diethyl phenol, 2,4,6-triethyl phenol, 2,6-dipropyl phenol, 2,4,6-tripropyl phosphite, cis-2-hexane, trans-2-hexane,2-ethyl-1,3-butadiene, 1,2-pentadiene, cis-1-hexene, trans-1-hexene, and di-isobuytylene.

10. The azeotrope-like compositions of claim 7 wherein said inhibitor is selected from the group consisting of diphenyl phosphite, triphenyl phosphite, tri-iso-octyl phosphite, di-octyl phosphite, tri-iso-decyl phosphite, 2,6-diethyl phenol, 2,4,6-triethyl phenol, 2,6-dipropyl phenol, 2,4,6-tripropyl phosphite, cis-2-hexane, trans-2-hexane,2-ethyl-1,3-butadiene, 1,2-pentadiene, cis-1-hexene, trans-1-hexene, and di-isobuytylene.

11. A method of cleaning a solid surface comprising treating said surface with an azeotrope-like composition of claim 1.

12. A method of cleaning a solid surface comprising treating said surface with an azeotrope-like composition of claim 3.

13. A method of cleaning a solid surface comprising treating said surface with an azeotrope-like composition of claim 4.

* * * * *

UNITED STATES PATENT AND TRADEMARK OFFICE

CERTIFICATE OF CORRECTION

PATENT NO. : 5,091,104

DATED : February 25, 1992

INVENTOR(S) : Michael Van Der Puy

It is certified that error appears in the above-identified patent and that said Letters Patent is hereby corrected as shown below:

Please amend colum 6, lines 51 - 55 as follows:

Azeotrope-like compositions consisting essentially of from about 20 to about 35 weight percent tertiary butyl 2,2,2-trifluoroethyl ether and from about 65 to about 80 weight percent perfluoromethylcyclohexane which boil at about 70.5°C at 754 mm Hg.

Signed and Sealed this

Twenty-ninth Day of June, 1993

*Attest:*

Michael K. Kirk

MICHAEL K. KIRK

*Attesting Officer*

*Acting Commissioner of Patents and Trademarks*